United States Patent [19]

Allan

[11] Patent Number: 4,519,898

[45] Date of Patent: May 28, 1985

[54] LOW SEVERITY DELAYED COKING

[75] Inventor: David E. Allan, Baton Rouge, La.

[73] Assignee: Exxon Research & Engineering Co., Florham Park, N.J.

[21] Appl. No.: 496,570

[22] Filed: May 20, 1983

[51] Int. Cl.[3] ..... C10G 9/14

[52] U.S. Cl. ..... 208/131

[58] Field of Search ..... 208/131, 50, 106

[56] References Cited

U.S. PATENT DOCUMENTS

| | | | |
|---|---|---|---|
| 2,380,713 | 7/1945 | Wilson | 208/131 |
| 2,775,549 | 12/1956 | Shea | 208/131 |
| 3,936,358 | 2/1976 | Little | 208/131 X |
| 3,956,101 | 5/1976 | Hara et al. | 208/131 X |
| 3,959,115 | 5/1976 | Hayashi et al. | 208/131 X |
| 4,036,736 | 7/1977 | Ozaki et al. | 208/106 |
| 4,066,532 | 1/1978 | Garcia | 208/131 |
| 4,168,224 | 9/1979 | Jansma | 208/131 |
| 4,178,229 | 12/1979 | McConaghy et al. | 208/50 |
| 4,332,671 | 6/1982 | Boyer | 208/131 X |

FOREIGN PATENT DOCUMENTS

| | | |
|---|---|---|
| 7411601 | 10/1970 | Japan . |
| 1372571 | 10/1974 | United Kingdom . |

*Primary Examiner*—D. E. Gantz
*Assistant Examiner*—Glenn A. Caldarola
*Attorney, Agent, or Firm*—Marthe L. Gibbons

[57] ABSTRACT

A delayed coking process is conducted at a relatively low temperature with the introduction of a gas into the coking drum to strip volatile matter from the coke product and to form coke containing 6 to 12 weight percent volatile matter. Low temperature delayed coking decreases the amount of coke yield, calculated on a volatile-free basis, and increases liquid yield.

8 Claims, 1 Drawing Figure

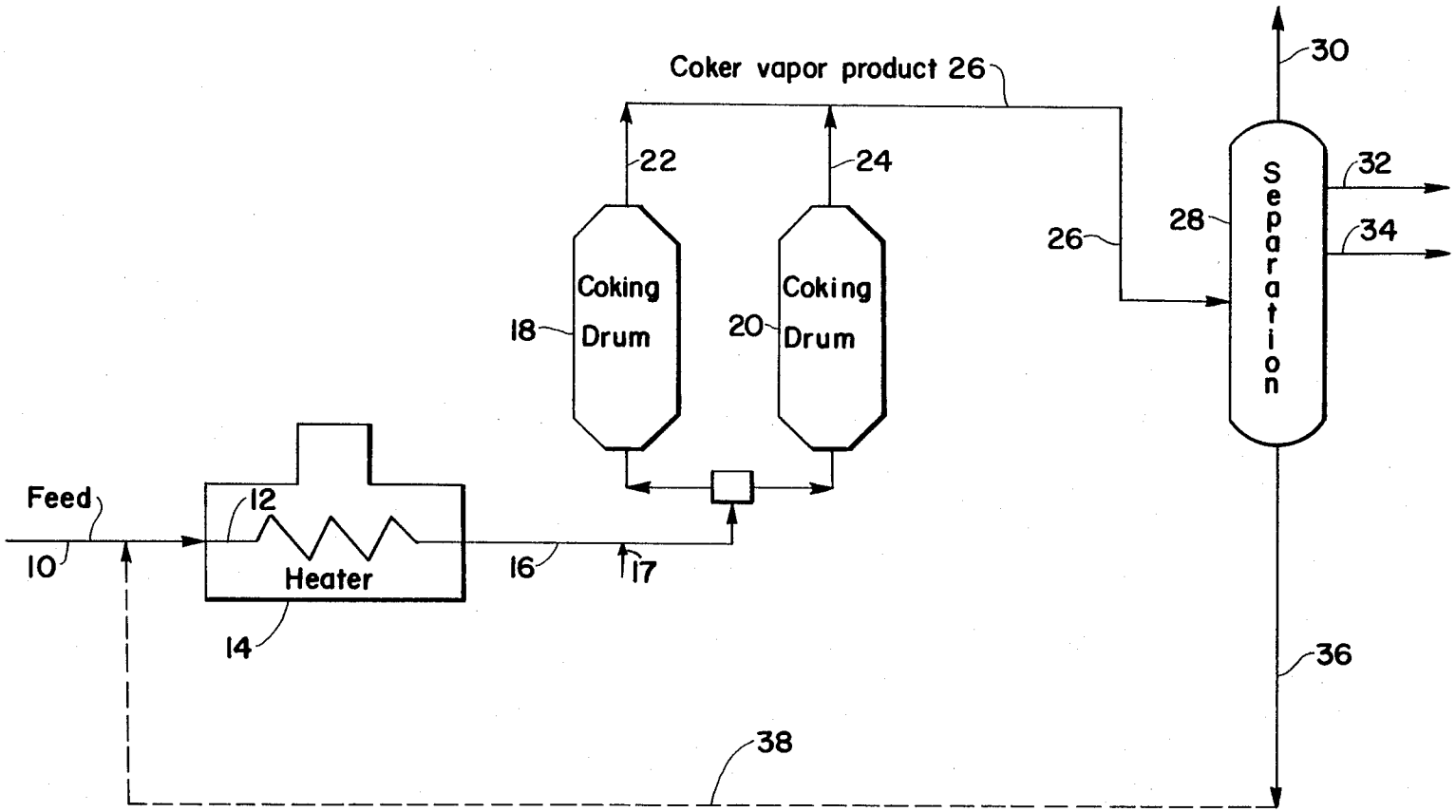
Separation
Coking Drum
Coking Drum
Heater
Coker vapor product 26
Feed
10
12
14
16
17
18
20
22
24
26
28
30
32
34
36
38

LOW SEVERITY DELAYED COKING

BACKGROUND OF THE INVENTION

1. Field of the Invention

This invention relates to an improvement in a delayed coking process.

2. Description of the Prior Art

Delayed coking is a well known process in which a hydrocarbonaceous oil is heated to a coking temperature and then passed into a coking drum to produce a vapor phase product, including normally liquid hydrocarbons, and coke. The drum is decoked by hydraulic means or by mechanical means. See *Hydrocarbon Processing*, September, 1980, page 153. The delayed coking process is generally conducted at a temperature ranging from about 800° to about 950° F. Typically, delayed coking is conducted at conditions, including a temperature above about 900° F., such that the coke product comprises from about 6 to about 12% volatile matter. When the content of volatile matter is below about 6 wt.%, the coke is harder and more difficult to remove from the drum. It has also been stated in the prior art that an increase in coking temperature decreases coke production and increases liquid hydrocarbon yield. The observed decrease in coke product, however, is relative to coke production at a lower temperature in which the coke contains a greater amount of volatile matter. Thus, if the coke production were to be compared on a volatile matter free basis, it would be seen that higher temperature operation produced more coke.

U.S. Pat. No. 4,036,736 discloses a delayed coking process to produce a synthetic coking coal and low sulfur fuel oil. The gaseous and liquid products from the coker are removed at accelerated velocity induced by the flow of inert gas or hydrocarbon gas. Volatile matter of the coke product is above 20 weight percent.

U.S. Pat. No. 3,956,101 discloses introducing an inert gas into a coking drum during the coking operation. The gas may be hydrogen, nitrogen, steam and hydrocarbon gases. The feed is heated in a two-step operation to produce a desired quality coke.

It has now been found that delayed coking can be conducted at a relatively low temperature while producing a coke having the desired content of volatile matter by introducing a specified amount of gas into the coking drum.

SUMMARY OF THE INVENTION

In accordance with the invention there is provided, in a delayed coking process which comprises the steps of:

(a) preheating a hydrocarbonaceous oil feed to a coking temperature, and (b) introducing the resulting preheated oil into a coking drum operated at delayed coking conditions to form coke and a vapor phase product, the improvement which comprises: said oil feed being preheated to a temperature ranging from about 775° to about 920° F., and introducing a gas into said coking drum in an amount ranging from about 5 to about 40 weight percent of said preheated oil to maintain the content of volatile matter of said coke in the range of about 5 to about 15 weight percent.

BRIEF DESCRIPTION OF THE DRAWING

The FIGURE is a schematic flow plan of one embodiment of the invention.

DESCRIPTION OF THE PREFERRED EMBODIMENT

Referring to the FIGURE, a hydrocarbonaceous oil feed is passed by line 10 into coil 12 of coking heater 14. Suitable hydrocarbonaceous oil feeds include heavy hydrocarbonaceous oils; heavy and reduced petroleum crudes; petroleum atmospheric distillation bottoms; petroleum vacuum distillation bottoms; pitch, asphalt, bitumen, other heavy hydrocarbon residues; tar sand oil; shale oil; liquid products derived from coal liquefaction processes and mixtures thereof. Typically, such feeds have a Conradson carbon content of at least about 5 wt.%, generally from about 5 to about 50 wt.%, preferably above about 7 wt.% (As to Conradson carbon residue, see ASTM test D189-65). These oils usually have a high metals content (vanadium, iron and nickel). The metal content may range up to 2000 wppm metal or more. The oil is preheated in heater 14 to a coking temperature such that the heater coil outlet temperature will range suitably from about 775° to about 920° F., preferably from about 850° to about 900° F. The heater coil outlet pressure will range from about 10 to about 200 psig, preferably from 50 to about 100 psig. In heater 14, the oil is partially vaporized and mildly cracked. The preheated oil (vapor-liquid mixture) is removed from heater 14 and passed by line 16 into one of two coking drums, 18 and 20 connected to coking heater 14. When one drum is in use, the other drum is being decoked. The coking drums operate at a somewhat lower temperature than the heater coil outlet temperature since the coking reaction is endothermic. The pressure in the coking drums ranges from about 20 to about 60 psig. The residence time in the coking drum is generally from about half an hour to about 36 hours, that is, for a time sufficient to fill the drum with coke. A gas is introduced into coking drum 18 by introduction into feed line 16 via line 17 in an amount ranging from about 5 to about 40 weight percent, preferably from about 10 to about 20 weight percent based on the weight of the preheated oil (e.g., of the total vapor-liquid mixture) that is introduced into the respective drum. Suitable gases include steam, nitrogen, normally gaseous hydrocarbons, natural gas and mixtures thereof. Preferably the gas comprises steam. The gas serves to strip the volatile matter from the coke in the drum, particularly since the coke produced at a relatively low temperature would comprise more volatile matter (e.g., entrapped gaseous product). The conditions in the coking drum and the amount of gas introduced into the coking drum are such as to produce a coke having a content of volatile matter ranging from about 5 to 15 weight percent, preferably from about 6 to about 12 weight percent as measured by ASTM test D-3175. Alternatively the gas may be introduced into the coking drum by introducing the gas into feed line 10. When the desired additional gas is steam, water, steam or mixtures thereof may be introduced into feed line 10 to convert the water to steam in coil 12. The vapor phase overhead product of the coking drum, which includes normally liquid hydrocarbons, is removed from the respective coking drums by lines 22 and 24 and passed, if desired with prior removal of light gases, by line 26 to a separation zone such as fractionator 28 where the coke overhead vapor product is separated into gas removed by line 30, a light fraction removed by line 32 and an intermediate boiling fraction removed by line 34. The heavier bottoms fraction of the fractionator is removed by line 36 and, if desired, may be recycled by line 38 to heater 14. Alternatively, a fresh hydrocarbonaceous oil, such as a crude oil, may be introduced into the fractionator and the heavier recycle product and the heavy portion of the fresh oil which combine in the fractionator may be passed to heater 14 by line 38 as feed for the process. Moreover, the fresh oil may be introduced with the bottom of the fractionator to blend with the bottoms of the coker products, and the blend may then be introduced into heater 14. After one of the coking drums is filled with coke, the coking drum is decoked by mechanical or hydraulic means such as by high impact water jet. The coke is then broken into lumps and, if desired, may be calcined. By operating at a lower temperature while stripping of volatiles from the coke product so as to obtain a coke having the desired amount of volatile matter, less coke is produced than would be produced by operating at a higher temperature without the introduction of gas.

EXAMPLES

The following examples are presented to illustrate the invention.

EXAMPLE 1

A light Arab atmospheric residuum having a Conradson carbon content of 8.5 weight percent was coked in a batch autoclave at liquid phase conditions. This batch operation is similar to the reactions which occur in a delayed coking drum. The results are summarized in Table I.

TABLE I

| Run | Elapsed Run Time, min. | Temperature, °F. | Yields, wt. % on Feed Gas | Coke |
|---|---|---|---|---|
| 14 | 11.7 | 888 | 6.4 | 8.4 |
| 16 | 12.0 | 870 | 3.9 | 1.0 |
| 19 | 15.3 | 873 | 11.5 | 10.4 |
| 20 | 15.3 | 850 | 4.4 | 3.6 |

As can be seen in Table I, at constant time, a reduction in temperature of 18° to 23° F. gave a decrease in coke production and a decrease in gas production.

EXAMPLE 2

An East Texas atmospheric residuum having a Conradson carbon content of 8.9 weight percent was used as feed in a once-through delayed coking process.

The conditions and once through yields are shown in Table II.

TABLE II

| Run | VB-138 | VB-135 |
|---|---|---|
| Conditions | | |
| Drum inlet temperature, °F. | 900 | 871 |
| Coil outlet pressure, psig | 25 | 25 |
| Steam, wt. % on feed | 9.7 | 19.1 |
| Once-through yields | | |
| $C_3^-$, wt. % | 2.4 | 1.9 |
| $C_4$, vol. % | — | 0.1 |
| $C_5^-$ 400°F. naphtha, vol. % | 10.3 | 9.4 |
| 400° F.+ gas oil, vol. % | 83.4 | 86.4 |

TABLE II-continued

| Run | VB-138 | VB-135 |
|---|---|---|
| Coke, wt. % | 9.5 | 7.6 |
| Other properties | | |
| Coke VCM[1] volatiles, wt. % | 12.1 | 11.1 |
| 400° F.+ Conradson carbon | 2.3 | 2.3 |

[1]Volatile combustible matter as determined by test ASTM D-3175

The data obtained on the once through coking were then calculated on the basis of 100% conversion of the feed. The calculated data are shown in Table III.

TABLE III

| Run No. | VB-138 | VB-135 |
|---|---|---|
| Yields, wt. %[1] | | |
| $C_4^-$ *Gas* | 4.0 | 3.5 |
| $C_5^-$ 400° F. Naphtha | 13.4 | 12.8 |
| 400–900° F. Gas Oil | 70.5 | 73.4 |
| Coke | 12.1 | 10.3 |
| | 100.0 | 100.0 |
| Coke volatiles, wt. % | 12.1 | 11.1 |

[1]calculated on basis of 100% conversion of feed.

The data from this experiment show that a decrease in drum temperature accompanied by an increase in gas injection (e.g., steam) improved the yields while keeping coke volatile matter constant. In the above experiment, the coke and gas yields were each reduced by 15% while net $C_5$-900° F. liquids increased by 2.3 weight percent on feed. On higher Conradson carbon oil feeds, the net liquid yields would be expected to be greater.

What is claimed is:

1. In a delayed coking process which comprises the steps of:

(a) preheating a hydrocarbonaceous oil feed to a coking temperature, and (b) introducing the resulting preheated oil into a coking drum operated at delayed coking conditions to form coke and a vapor phase product, the improvement which comprises: said oil feed being preheated to a temperature ranging from about 775° to 920° F., and introducing a gas into said coking drum during step (b), in an amount ranging from about 10 to about 20 weight percent of said preheated oil to maintain the content of volatile matter of said coke in the range of about 5 to about 15 weight percent.

2. The process of claim 1 wherein said gas is selected from the group consisting of steam, nitrogen, normally gaseous hydrocarbons and mixtures thereof.

3. The process of claim 1 wherein said oil feed is preheated to a temperature ranging from about 850° to about 900° F.

4. The process of claim 1 wherein said gas comprises steam.

5. The process of claim 1 wherein said hydrocarbonaceous oil has a Conradson carbon content of at least about 5 weight percent.

6. The process of claim 1 wherein the volatile matter of said coke ranges from about 6 to about 12 weight percent.

7. The process of claim 1 wherein said gas is added to said preheated oil of step (b).

8. The process of claim 1 wherein said gas is added to said oil feed prior to said preheating step.

* * * * *